United States Patent [19]

Charest

[11] Patent Number: 4,987,943

[45] Date of Patent: Jan. 29, 1991

[54] WEDGING ASSEMBLY FOR SEALING AN EDGE OF A WINDOW SHADE

[75] Inventor: Gérald Charest, Malartic, Canada

[73] Assignee: Cel-Franc Inc., Val d'Or, Canada

[21] Appl. No.: 453,881

[22] Filed: Dec. 20, 1989

[51] Int. Cl.[5] ..... E06B 9/17

[52] U.S. Cl. ..... 160/269; 160/41; 160/120

[58] Field of Search ..... 160/269, 268.1, 273.1, 160/23.1, 120, 25, 31, 41

[56] References Cited

U.S. PATENT DOCUMENTS

| | | | |
|---|---|---|---|
| 1,387,452 | 8/1921 | Chapin | 160/269 |
| 1,673,326 | 6/1928 | Goldsmith | 160/269 |
| 1,836,387 | 12/1931 | Nye | 160/269 X |
| 2,579,159 | 12/1951 | Starr | 160/269 |
| 3,803,671 | 3/1974 | Stuppy et al. . | |
| 4,220,189 | 5/1980 | Marquez . | |
| 4,357,978 | 11/1982 | Keller et al. | 160/41 |
| 4,399,855 | 8/1983 | Volfson | 160/23.1 |
| 4,458,739 | 7/1984 | Murray et al. | 160/269 X |
| 4,467,504 | 11/1984 | Quist . | |
| 4,480,676 | 7/1984 | Solomon . | |

OTHER PUBLICATIONS

Abstract of U.S. Pat. No. 2,509,398 of May 30, 1950, "Auxiliary Window Scree and Shade Construction", E. P. Bayside et al., U.S. Patent Office Gazette, p. 1467.

*Primary Examiner*—David M. Purol

*Attorney, Agent, or Firm*—Edwin E. Greigg

[57] ABSTRACT

A profile assembly is disclosed for the wedge-sealing of a sheet of flexible material, especially a window shade. It comprises a set of male and female extruded plastic profiles. The female profile is U-shaped and defines an open housing, one of its legs has, at its free end, a resilient sealing lip turned into the housing while the other leg has, also at its free end, a first wedging lip. The male profile is L-shaped and has a wedging branch and a base branch, the two making between them an inner angle of less than 90°. Furthermore, the base branch includes, at the end away from the wedging branch, an upright arm having a second wedging lip on its face that looks toward the first wedging lip. The sealing lip, when unstressed, and the first wedging lip are spaced apart a predetermined distance, this length and this distance being selected to allow, in use, with the wedging branch inserted into the housing and with an edge of the window shade slid between the sealing lip and the wedging branch, the second lip to be brought first against the first lip, then to be moved over the first lip thereby causing the shade to be sealed pressed against the sealing lip by the wedging branch, and thereafter the second lip to fall behind the first lip and be snapped into interlocking engagement therewith within the housing while the shade remains sealed pressed against the sealing lip by the wedging branch.

20 Claims, 4 Drawing Sheets

WEDGING ASSEMBLY FOR SEALING AN EDGE OF A WINDOW SHADE

BACKGROUND OF THE INVENTION

1. Field of the invention

The present invention relates to a profile assembly for wedge-sealing an edge of a sheet of flexible material. In its preferred form, the invention is part of a window shade sealing system for sealing the lateral edges of a window shade covering a window having lateral frame members, the system then having two profile assemblies, each disposed along one of the two lateral window frame members, for sealing the border edges of the shade.

2. Description of the prior art

Many attempts have been made in recent years, due to the increasing costs of heating buildings of all types, to reduce heat dissipation by leakage of outside air through windows. One solution has been to use permanent thermal window glass or to provide windows with a double pane but these solutions are expensive. Less expensive has been the use of sheets of transparent material fixed over the frame of windows by adhesive strips but this solution is not found efficient, convenient nor aesthetic. More efficient structures have also been suggested which reside in the use of a flexible sheet of transparent material, such as polyethylene, wound on a roller mounted in a housing and drawn through a payout slot; the edges of the shade being slid along guide channels and sealed therein in various ways. Structures of this type are known to Applicant from the following U.S. patents:

2,509,398 of 1950
3,225,407 of 1965
3,783,931 of 1974
3,803,671 of 1974
4,467,504 of 1984

Of relevance with respect to the present invention, are U.S. Pat. No. 4,220,189 and U.S. Pat. No. 4,480,676. In the former, a spring clip presses the edge of the sheet against a flat surface. As the shade is drawn down through the guide channel, difficulty arises if the pressure of the clip is too strong, and air tends to seep through the channel if the clip is too weak, which may happen if the clip loosens with use. In the latter U.S. Pat. No. 4,480,676, spaced sealing members press lightly on opposite sides of the edges of the shade to give it a curvilinear configuration purporting to seal the edge of the shade. However, the sealing members do not really press on the shade but rather simply guide it in the curvilinear configuration rendering sealing rather haphazard. Perhaps more pertinent to the present invention are the attaching devices of the other two U.S. Pat. Nos. 3,803,671 and 4,467,504. In both cases, a channel-shaped housing, having a vertical opening, receives the edge of the flexible shade which is forcibly pressed therein by a plug. The sealing is efficient but the structure, both of the housing and of the plug, is complex and thus expensive as well as difficult to handle both in securing the shade edge in the housing and in removing the plug from it.

SUMMARY OF THE INVENTION

The object of the present invention is to provide a profile assembly of the wedge-sealing type for use in sealing an edge of a sheet of flexible material, which assembly is devoid of the aforesaid difficulties. It is made up of a U-shaped female profile and a cooperating L-shaped male profile. The female profile has a flexible sealing lip on one leg and a first wedging lip on the other leg. The male profile, on the other hand, is formed with a wedging branch adapted, during an initial movement of the male profile into the female profile, to press the edge of the sheet against the sealing lip, and with a second wedging lip cooperating with the first wedging lip, to force the wedging branch against the female member sealing lip with the edge of the shade clamped therebetween. Further inward movement of the second wedging lip moves it behind the first wedging lip and locks the two profiles together. Also, means are provided to prevent further inward movement of the wedging branch of the male profile into the housing of the female profile when the wedging lips are interlocked.

More specifically, the invention lies in the provision of a profile assembly for wedge-sealing an edge of a sheet of flexible material, the assembly comprising:

a U-shaped female profile having a pair of opposed legs and defining a housing opened at the free ends of the legs; one of the legs having, at the free end thereof, a sealing lip turned into the housing and made of resilient material; the other leg having at the free end thereof, a first wedging lip facing the sealing lip;

a generally L-shaped male profile having a wedging branch and a base branch, the branches making therebetween an inner wedging angle of less than 90°; wherein the base branch includes, at the end thereof away from the wedging branch, an upright arm having a second wedging lip on the face of the arm looking away from the wedging branch;

wherein the sealing lip, when unstressed, and the first wedging lip are spaced apart a predetermined distance and wherein the length of the base branch is greater than the distance; the length and the distance being selected to allow, in use with the wedging branch inserted in the housing and with an edge of the window shade slid between the sealing lip and the wedging branch: the second lip to be brought first against the first lip, then to be moved over the first lip thereby causing the shade to be sealed pressed against the sealing lip by the wedging branch, and thereafter the second lip to fall behind the first lip and be snapped into interlocking engagement therewith within the housing while the shade remains sealed pressed against the sealing lip by said wedging branch, and means preventing further inward movement of the male profile into the housing when the first and second wedging lips are interlocked.

Preferably, the means which prevent further inward movement of the male profile into the housing comprise a coplanar extension of the base branch past the upright arm and facing the first wedging lip.

The assembly may advantageously include further means retaining the male profile within the female profile when the two are free of interlocking engagement. Such retaining means may comprise a pair of coplanar retaining walls in the housing, parallel to the web of the U-shaped female member, and having free edges spaced apart to define a slot of predetermined width; the end of the wedging branch, away from the base branch, extending through the slot. Such further means also include a cross member extending transversely of the wedging branch, at its free end, this cross member having a length which is greater than the width of the slot.

Other features of the invention will appear from the description that follows of a preferred embodiment having reference to the appended drawings.

BRIEF DESCRIPTION OF THE DRAWINGS

FIG. 9 is an exploded, cross-sectional view of a profile assembly similar to that of FIG. 2, and of a fixation member that may be used to secure it onto the inner surface of a sash frame;

FIG. 10 is a view similar to that of FIG. 9, showing another fixation member that may be used to secure the same profile assembly onto the front or rear surface of a sash frame.

DESCRIPTION OF THE PREFERRED EMBODIMENT

Figure 1:
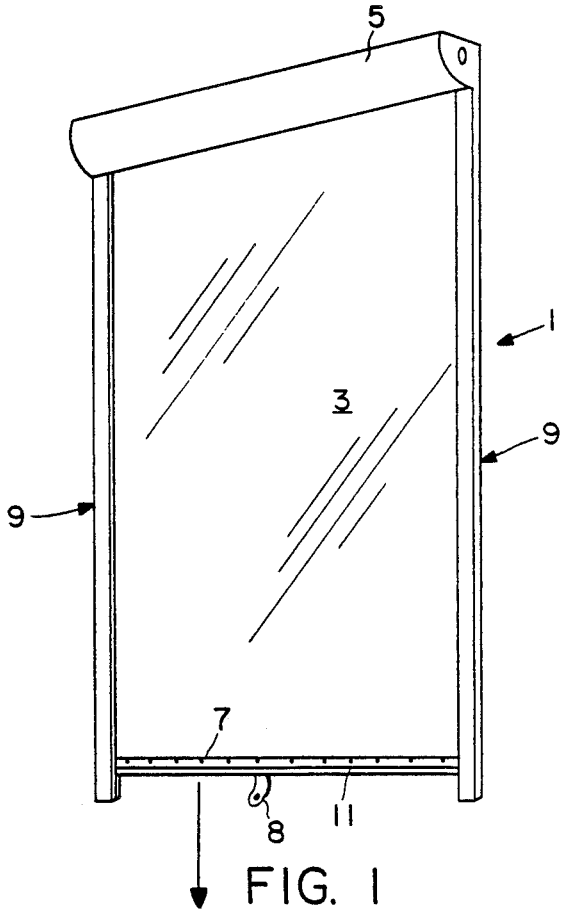
FIG. 1 is a somewhat diagrammatic front perspective view a window provided with a sealing system including a pair of profile assemblies made according to the invention, mounted on either sides of the window and fixed to its lateral frame member.

FIG. 1 shows a window 1 covered on the inside with a shade 3 made of any sheet of flexible transparent material such as polyethylene. The shade 3 is wound on a spring-biased roller (not shown) mounted in known manner and contained in a housing 5 made air tight but having a pressure slit allowing paying out of the shade 3. As the shade is pulled down by means of a rigid slat 7 at its lower end, using a pull tag 8, its edges are guided along a pair of profile assemblies 9 made according to the invention and secured to the side members of the window as will be explained in greater details hereinafter.

Figure 7:
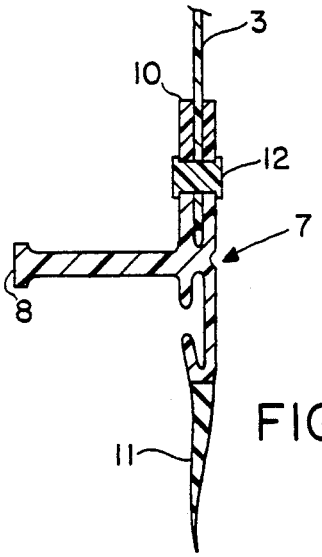
FIG. 7 is a cross-sectional view of a slat to be fixed to the lower edge of the window shade.

As shown in FIG. 7, the slat 7 may consist of a profile member made of extruded plastic material. The upper edge of the profile member is vertically slotted at 10 to receive the lower edge of the window shade. Plastic rivets 12 may be forced-fitted into transversal through-holes made in both the profile member and window shade, to provide permanent fixation of the shade 3 to the slat 7. The lower edge of the profile member is integrally extended by a sealing lip 11 of resilient material coextruded with the member. This lip 11 is intended to be applied to the window still when the shade 3 is fully pulled down, to prevent heat dissipation.

Figure 8:
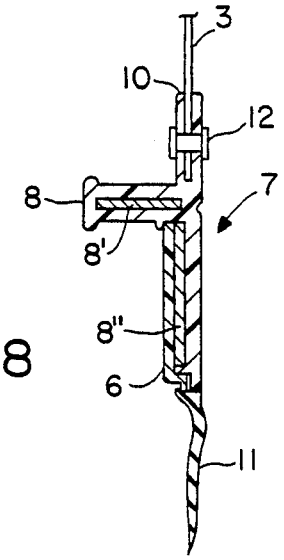
FIG. 8 is a cross-section view of a variant of the slat shown in FIG. 7.

A perpendicular flange 8 may be provided in between the upper and lower edges of the profile member to make the slat 7 easier to grasp. As shown in FIG. 8, the flange 8 may be hollowed out to receive a strengthening metal flat bar 8' whenever necessary, such as, for example, when the slat is long and subject to eventual deformation and bending.

The lower edge of the profile member may also be shaped to receive another flat metal bar 8" extending perpendicular to the bar 8' in order to further strenght in the slat. For this purpose, the lower end of the slat 7 may be provided with a T-shaped slat, as shown in FIG. 8, for receiving the other metal bar. Alternatively the lower end of the slat may be made up of two separate easy-to-connect members which when they are assembled, together form a cavity sized to receive the bar 8', as shown in FIG. 8. One of these two separate members may be integral to the slat 7 whereas the other member may be shaped as a flap or cover 6 that may be snaped or slid into fixation grooves integral to the slat 7, as is also shown in FIG. 8.

Figure 2:
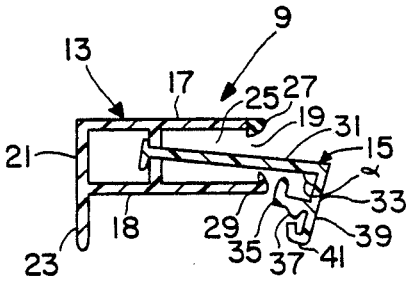
FIG. 2 is a cross-sectional view of a profile assembly according to the invention, in non-use position.

Turning now to FIG. 2, each profile assembly 9 according to the invention is made up of a U-shaped female profile 13 and a generally L-shaped male profile 15, both extruded out of any suitable plastic material in indefinite lengths.

The female profile 13 has a pair of parallel legs 17, 18, free at one end to define a male profile-insertion opening 19 and closed at the other end by a web 21. A coplanar extension 23 of the web 21 serves to secure the female profile 13 to the riser of a sash frame as will be explained hereinafter in greater details.

The legs 17, 18, and the web 21 define a housing 25 provided with the opening 19. The leg 17 has a sealing lip 27 which turns inside into the housing 25 and which is made of resilient material, such as rubber, coextruded with the profile 13 and solid with leg 17. Its surface is preferably roughened to increase its coefficient of friction and sealing quality. The other leg 18 of the profile 13 has a first wedging lip 29 which faces the sealing lip 27.

Figure 3:
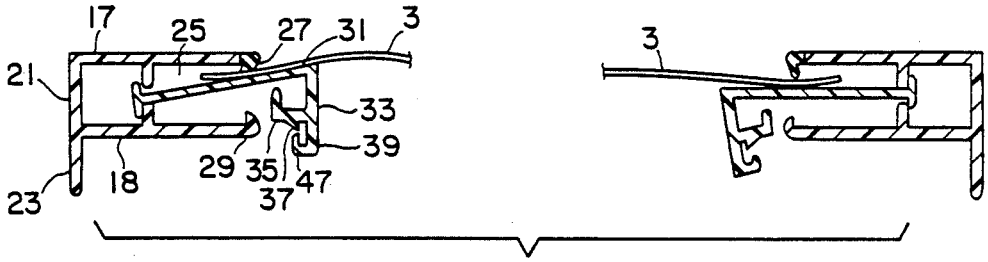
FIG. 3, 4 and 5 show, in cross-sections similar to that of FIG. 2, a pair of profile assemblies, one for each edge of a window shade, in successive positions leading to firm the edges of the shade.

The essentially L-shaped male profile 15 is formed of a wedging branch 31 and of a base branch 33, making between them an inner wedging angle $\alpha$ of less than 90°, as shown. The base branch includes, at its end which is away from the wedging branch 31, an upright arm 35, preferably perpendicular to it. The arm 35 has a second wedging lip 37 on its face which looks away from the wedging branch 31. It is to be pointed out here that the length of the base branch 33 is greater than the distance between the sealing lip 27, when unstressed, and the first wedging lip 29, that is greater than the length of the opening 19. These two lengths are selected so as to allow, in use with the wedging branch 31 inserted in the housing 25 and with a lateral edge of the window shade 3 slid between the sealing lip 27 and the wedging branch 31, as in FIG. 3: first the second wedging lip 37 to be brought against the first wedging lip 29 (FIG. 4) thereby causing the wedging branch 31 to press the shade 3 against the sealing lip 27; second, the second wedging lip 37 to move on top of the first lip 29 causing the wedging branch 31 to press the shade 3 further against the sealing lip 27 and, finally, the same second lip 37 to fall behind the first wedging lip 27, in the housing 25, to be snapped into interlocking engagement with it, as in FIG. 5; the shade 3 remaining sealed pressed against the sealing lip 27 by the wedging branch 31.

Means are also provided to prevent further inward movement of the male profile 15 into the housing 25 when the first and second wedging lips 29, 37, are interlocked. Such means can take the form of a coplanar extension 39 of the base branch 33 past the upright arm 35; the extension 39 thus facing the end of the leg 18 and the first wedging lip 29 thereby preventing any further insertion of the male member 15 into the housing 25, as clearly shown in FIG. 5. Other means would be to have the clamping branch 31 long enough so that its inward end touches the web 21 in the situation illustrated in FIG. 5.

Further means may also be provided to retain the male profile 15 within the female profile 13 when the profiles are not interlocked, as in FIG. 2. Such means may comprise a pair of coplanar retaining walls 41 having spaced apart free edges that define a slot 43 of predetermined width (best shown in FIG. 4); the inward end of the wedging branch 31 extending through the slot 43 and being provided with a cross member 45 having a length greater than the width of the slot 43 so that the male profile 15 may not be withdrawn from the female profile except by being slid lengthwise and removed through one of the open ends of the said female profile 13.

Figure 4:
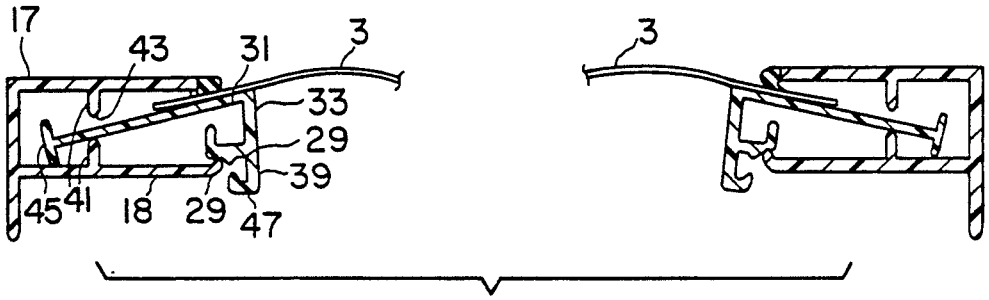

Preferably, the first and second wedging lips 29, 37, form right-angle triangle, in cross-section, with their hypothenuses facing one another when the lips are moved against one another, as in FIG. 4.

Figure 5:
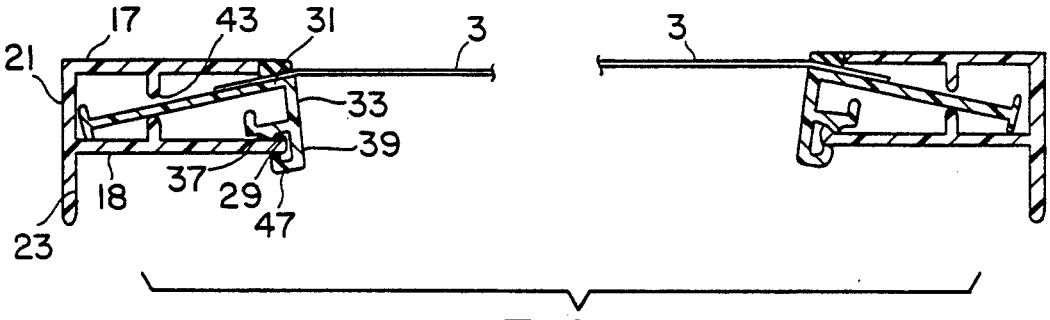

To unlock the two profiles 13, 15, from their position in FIG. 5, releasing means may be provided in the form of a lever 47 formed on the coplanar extension 39. By twisting the lever 47 counterclockwise, it is possible, due to the limited resiliency of the legs 17, 18, of the female member, to force the second wedging lip 37 in front of the first one 29 to reach the original situation in FIG. 4.

Figure 6:
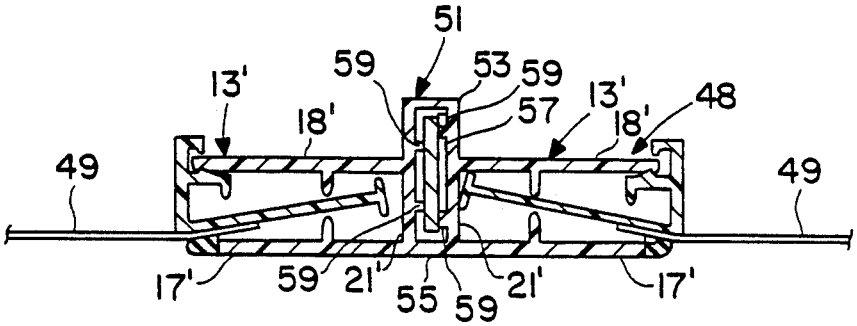
FIG. 6 is a cross-sectional view of a profile unit for the wedge-sealing of adjacent edges of a pair of adjoining shades, the unit making use of two assemblies as shown in FIG. 2.

FIG. 6 shows a profile unit 48 for wedge-sealing adjacent edges of a pair of essentially coplanar sheets 49 of flexible material acting together as a single shade for covering large windows such as those of patio doors. Two profile assemblies are used which are identical to the assembly 9 described above except that they are secured together. As shown in FIG. 6, the webs 21' of the female profiles 13' are spaced from and face one another and the opposed legs 17', 18' thereof are coplanar two-by-two. As also shown in FIG. 6, wall means 51, solid with the spaced webs 21', are provided which define a chamber 53 opened at the ends of the assemblies; the wall means 51 including a back wall 55 which merges with the two coplanar legs 17' of the two assemblies. A connection member 57, which may be a flat metal bar, is mounted in and extends out of the chamber 53. Ribs 59, within the chamber 53 and on opposed webs 21' press on either side of the bar or strip 57 to hold it in the chamber although allowing it to be slid in or out. The ends of the bar 57 may be provided with conventional means (not shown) to fix it, and thus the unit 48, to the lintel and sill of the window or door frame, at the center thereof.

As explained hereinabove, the coplanar extension 23 of the web 21 of the female profile 13 of each profile assembly 9 is intended to be used for fixing the assembly 9 to the riser of a window or door sash frame.

Such a fixation can be made by means of flat head screws (not shown) inserted into prepunched holes (not shown) provided in the extension 23. Preferably however, such a fixation is made as in shown in FIGS. 9 to 11, by means of fixation members that may be extruded out of the same plastic material as the male and female profiles 13, 15, in indefinite lengths.

The extruded fixation member 61 that is shown in FIG. 9 is designed for use to fix the profile assembly 9 onto the inner surface 63 of the riser 65 of the sash frame, i.e. the surface that faces "inwards" and thus extends perpendicular to the window. The member 61 is U-shaped and comprises a flat base 67 that can be applied onto the surface 63 and be fixed thereto by means of screws 69. It also comprises two hook-shaped arms 71, 73 designed to grasp and retain the female profile 13 when its web 21 and extrusion 23 are snaped inside the member 61. To improve the sealing quality of the assembly, the web 21 of the female profile 13 and the base 67 of the fixation member 61 may be provided with an integral sealing lip 75, 77 made of a resilient material coextruded therewith, with the lip 75 extending opposite to the opening 19 and being long enough to bear against the base 67 when the profile 13 is snaped into the member 61 and the lip 77 extending opposite to the arms 71 and 73 to bear against the surface 63 when the member 61 is screwed onto the riser 65.

In some cases, as shown in FIG. 10, there is not enough room on the inner surface 63 of the riser 65 to fix the member 61, because of the width of the window or door sash. Then, use can be made of another extruded fixation member 81 that is attachable to the rear surface 64 of the riser of the sash frame. The fixation member 81 has a generally rectangular triangular shape in cross-section and comprises one face 83 with a set of positioning tongues 85, 87 intended to be applied onto the surface 64, and another face 89 perpendicular to the one face 83 which acts as a support for receiving the female profile 13. One of the tongues, i.e. the one numbered 87, extends parallel to the face 83 and may be used to fix the member 81 with screws 69 onto the surface 64 of the riser 65. To retain the profile 13, the face 89 is provided with a pair of hook-shaped arms 91, 93 sized and spaced apart to receive and grasp the web 21 and extension 23 when the female profile 13 is snaped into the member 81. Once again, the lip 75 projecting from the web 21 bears against the face 89 and acts as a seal.

As shown in FIG. 10, the arm 91 and tongue 87 may be formed as a unitary structure, thereby allowing the head of the screws 69 to be hidden from sight as soon as the profile 13 is snaped on. As also shown, the third face 95 of the member 81 may be also given any decorative aspect.

Figure 11:
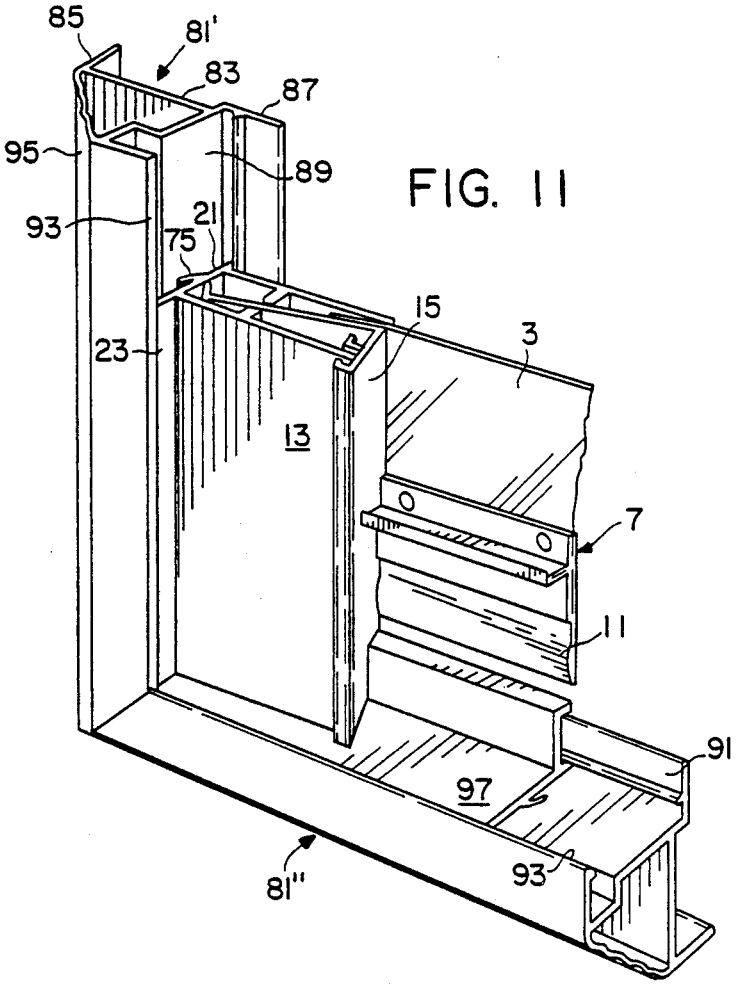
FIG. 11 that appears on the same sheet of drawings as FIG. 8, is a perspective view of the bottom corner of a fixation frame made from fixation members as shown in FIG. 10.

As shown in FIG. 11, the member 81 may be cut into bevelled lengths 81', 81", and assembled to form a frame. To "close" the lower length 81" and give a nice finish to the resulting frame, a further L-shaped extruded member 97 sized to be snapped between the arms 91, 93 and formed with an integral sealing lip 99, may be provided for.

I claim:

1. A profile assembly for wedge-sealing an edge of a window shade comprised of a sheet of flexible material, said assembly comprising:

a U-shaped female profile having a pair of opposed, free-ended legs and defining a housing opened at the free ends of said legs; one of said legs having, at the free end thereof, a sealing lip turned into said housing and made of resilient material; the other leg having at the free end thereof, a first wedging lip facing said sealing lip;

a generally L-shaped male profile having a wedging branch and a base branch, said branches making therebetween an inner wedging angle of less than 90°; wherein said base branch includes, at the end thereof away from said wedging branch, an upright arm having a second wedging lip on the face of said arm looking away from said wedging branch;

wherein said sealing lip, when unstressed, and said first wedging lip are spaced apart a predetermined distance and wherein the length of said base branch is greater than the said distance; said length and said distance being selected to allow, in use with said wedging branch inserted in said housing and with an edge of said window shade slid between said sealing lip and said wedging branch: said second lip to be brought first against said first lip, then to be moved over said first lip thereby causing said shade to be sealed pressed against said sealing lip by said wedging branch, and thereafter said second lip to fall behind said first lip and be snapped into interlocking engagement therewith within said housing while said shade remains sealed pressed against said sealing lip by said wedging branch, and means preventing further inward movement of said male profile into said housing when said first and second wedging lips are interlocked.

2. An assembly as claimed in claim 1, wherein said means preventing further inward movement of said male profile into said housing comprise:

a coplanar extension of said base branch past said upright arm and facing said first wedging lip.

3. An assembly as claimed in claim 1, including means retaining said male profile within said female profile when said profiles are free of said interlocking engagement.

4. An assembly as claimed in claim 3, wherein said U-shaped female profile has a web at the bottom of said housing and said retaining means comprise:

a pair of coplanar retaining walls in said housing, parallel to said web and having free edges spaced apart to define a slot of predetermined width; the end of said wedging branch, away from said base branch, extending through said slot, and a cross member extending transversely of said wedging branch, at said end of said wedging branch; said cross member having a length greater than the width of said slot.

5. An assembly as claimed in claim 1, wherein said first and second wedging lips form right-angle triangles, in cross-section, with the hypothenuses facing one another when said lips are moved against one another.

6. An assembly as claimed in claim 4, wherein said first and second wedging lips form right-angle triangles, in cross-section, with the hypothenuses facing one another when said lips are moved against one another.

7. An assembly as claimed in claim 2, further comprising releasing means on said male profile for unlocking said wedging lips.

8. An assembly as claimed in claim 7, wherein said releasing means comprise a lever formed on said coplanar extension of said base branch.

9. An assembly as claimed in claim 4, further comprising releasing means on said male profile for unlocking said wedging lips.

10. An assembly as claimed in claim 1, wherein said sealing lip has a roughened surface for enhancing the sealing effect thereof.

11. An assembly as claimed in claim 1, wherein said arm of said male profile extends at right angle to said base branch.

12. An assembly as claimed in claim 4, wherein said arm of said male profile extends at right angle to said base branch.

13. A window shade sealing system for sealing lateral edges of a window shade covering a window having lateral frame members, said system comprising a pair of assemblies for wedge-sealing an edge of a sheet of flexible material, each said assembly comprising:

a U-shaped female profile having a pair of opposed, free-ended legs and defining a housing opened at the free ends of said legs; one of said legs having, at the free end thereof, a sealing lip turned into said housing and made of resilient material; the other leg having at the free end thereof, a first wedging lip facing said sealing lip;

a generally L-shaped male profile having a wedging branch and a base branch, said branches making therebetween an inner wedging angle of less than 90°; wherein said base branch includes, at the end thereof away from said wedging branch, an upright arm having a second wedging lip on the face of said arm looking away from said wedging branch;

wherein said sealing lip, when unstressed, and said first wedging lip are spaced apart a predetermined distance and wherein the length of said base branch is greater than the said distance; said length and said distance being selected to allow, in use with said wedging branch inserted in said housing and with an edge of said window shade side between said sealing lip and said wedging branch; said second lip to be brought first against said first lip, then to be moved over said first lip thereby causing said shade to be sealed pressed against said sealing lip by said wedging branch, and thereafter said second lip to fall behind said first lip and be snapped into interlocking engagement therewith within said housing while said shade remains sealed pressed against said sealing lip by said wedging branch, means preventing further inward movement of said male profile into said housing when said first and second wedging lips are interlocked, and each said assembly being disposed along one of said lateral frame members and having the U-shaped female profiles thereof secured to one of said frame members.

14. A system as claimed in claim 13, including, for each of said assemblies, means retaining said male profile within said female profile when said profiles are free of said interlocking engagement.

15. A system as claimed in claim 14, further comprising a U shaped fixation member attachable to an inner surface of each of said lateral frame member and wherein said fixation members are both provided with retaining means on which said female profiles may be snaped.

16. A system as claimed in claim 14, further comprising other fixation members having the general shape of a rectangular triangle, each of said other members having one side attachable to a front or rear surface of the corresponding lateral frame members and another side perpendicular to the one side, said other side being provided with retaining means on which one of said female profile may be snaped.

17. A system as claimed in claim 14, further comprising a spring-biased roller on which said window shade is wound, and a slat fixed by rivets to the window shade, said slat extending transversely to said lateral frame members and being moveable together with said shade.

18. A profile unit for wedge-sealing adjacent edges of a pair of essentially coplanar sheets of flexible material, said profile unit comprising two profile assemblies, each said assembly comprising:

a U-shaped female profile having a pair of opposed, free-ended legs and defining a housing opened at the free ends of said legs; one of said legs having, at the free end thereof, a sealing lip turned into said housing and made of resilient material; the other leg having at the free end thereof, a first wedging lip facing said sealing lip;

a generally L-shaped male profile having a wedging branch a base branch, said branches making therebetween an inner wedging angle of less than 90°; wherein said base branch includes, at the end thereof away from wedging branch, an upright arm having a second wedging lip on the face of said arm looking away from said wedging branch;

wherein said sealing lip, when unstressed, and said first wedging lip are spaced apart a predetermined distance and wherein the length of said base branch is greater than the said distance; said length and said distance being selected to allow, in use with said wedging branch inserted in said housing and with an edge of said window shade slid between said sealing lip and said wedging branch: said second lip to be brought first against said first lip, then to be moved over said first lip thereby causing said shade to be sealed pressed against said sealing lip by said wedging branch, and thereafter said second lip to fall behind sag first lip and be snapped into interlocking engagement therewithin said housing while said shade remains sealed pressed against said sealing lip by said wedging branch, means preventing further inward movement of said mole profile into said housing when said first and second wedging lips are interlocked, further wherein each said U-shaped female profile has a web at the bottom of the housing thereof, said female profiles are disposed with said webs spaced from and facing one another, said opposed legs are coplanar two-by-two, said unit further comprising wall means closing said space between said webs to form a chamber opened at the ends of said assemblies, said wall means including a back wall merging with two coplanar legs of said assemblies, and said unit further comprising a connection member mounted in an extending out of said chamber through the open ends thereof.

19. A unit as claimed in claim 18, including, for each of said assemblies, means retaining said male profile within said female profile when said profiles are free of said interlocking engagement.

20. A unit as claimed in claim 19, wherein said connection member is an elongated metal strip and ribs, within said chamber, pressing on either side of said strip to hold it therein.

* * * * *